US008844233B2

(12) United States Patent
Wilson et al.

(10) Patent No.: US 8,844,233 B2
(45) Date of Patent: Sep. 30, 2014

(54) FOAM INSULATION BOARD WITH EDGE SEALER

(75) Inventors: Richard C. Wilson, Farmington Hills, MI (US); Bruce Wilson, legal representative, Farmington Hills, MI (US); Patrick M. Culpepper, Massillon, OH (US)

(73) Assignee: Progressive Foam Technologies, Inc., Beach City, OH (US)

( * ) Notice: Subject to any disclaimer, the term of this patent is extended or adjusted under 35 U.S.C. 154(b) by 141 days.

(21) Appl. No.: 13/241,949

(22) Filed: Sep. 23, 2011

(65) Prior Publication Data

US 2012/0073217 A1 Mar. 29, 2012

Related U.S. Application Data

(60) Continuation-in-part of application No. 12/817,313, filed on Jun. 17, 2010, which is a division of application No. 11/025,623, filed on Dec. 29, 2004, now Pat. No. 7,762,040.

(60) Provisional application No. 60/600,845, filed on Aug. 12, 2004.

(51) Int. Cl.

| | |
|---|---|
| ***E04F 13/08*** | (2006.01) |
| ***E04F 13/14*** | (2006.01) |
| *E04F 13/00* | (2006.01) |

(52) U.S. Cl.

CPC ..... *E04F 13/0864* (2013.01); *E04F 13/08* (2013.01); *E04F 13/007* (2013.01); *E04F 13/0875* (2013.01); *E04F 13/141* (2013.01)

USPC ..... 52/519; 52/520; 52/534; 52/555; 52/745.21; 52/105

(58) Field of Classification Search

CPC ..... E04F 13/007; E04F 13/00; E04F 13/08; E04F 13/0864; E04B 7/02; E04B 7/00; E04B 1/62; E04D 11/00

USPC ..... 52/309.12, 522, 535, 518, 519, 520, 52/555, 530, 534, 536, 407.1, 302.1, 52/302.3, 409, 745.21, 105

See application file for complete search history.

(56) References Cited

U.S. PATENT DOCUMENTS

| | | |
|---|---|---|
| 1,776,116 A | 1/1928 | Harvey |
| 1,882,529 A | 3/1931 | Thulin |

(Continued)

FOREIGN PATENT DOCUMENTS

| | | |
|---|---|---|
| CA | 721719 | 11/1965 |
| CA | 794590 | 9/1968 |

(Continued)

*Primary Examiner* — Phi A

(74) *Attorney, Agent, or Firm* — Richard M. Klein; Fay Sharpe LLP

(57) ABSTRACT

Disclosed herein are embodiments of foam backing panels for use with lap siding and configured for mounting on a building. Also disclosed are lap siding assemblies and products of lap sidings. One such embodiment of the foam backing panel comprises a rear face configured to contact the building, a front face configured for attachment to the lap siding, alignment means for aligning the lap siding relative to the building, means for providing a shadow line, opposing vertical side faces, a top face extending between a top edge of the front face and rear face and a bottom face extending between a bottom edge of the front face and rear face. At least one of the faces includes a pre-installed adhesive for joining adjacent panels together.

17 Claims, 12 Drawing Sheets

(56) References Cited

U.S. PATENT DOCUMENTS

| | | | | | |
|---|---|---|---|---|---|
| 1,998,425 | A | | 7/1934 | McNeil | |
| 2,317,926 | A | | 12/1939 | Lindahl | |
| 2,308,789 | A | | 2/1940 | Stagg | |
| 2,230,702 | A | * | 2/1941 | Siebert | 52/385 |
| 2,231,007 | A | | 2/1941 | Vane | |
| 2,264,961 | A | * | 12/1941 | Ward | 52/302.3 |
| 2,316,345 | A | * | 4/1943 | Logan, Jr. | 52/314 |
| 2,727,283 | A | * | 12/1955 | Gollner | 52/478 |
| 2,899,716 | A | * | 8/1959 | Woodward | 52/302.3 |
| 3,034,261 | A | | 5/1962 | Hollmann et al. | |
| 3,110,130 | A | * | 11/1963 | Trachtenberg | 52/545 |
| 3,124,427 | A | | 3/1964 | Chomes | |
| 3,284,980 | A | | 11/1966 | Dinkle | |
| 3,289,371 | A | | 12/1966 | Pearson et al. | |
| 3,318,056 | A | * | 5/1967 | Thompson | 52/105 |
| 3,420,024 | A | * | 1/1969 | Salvo | 52/316 |
| 3,608,261 | A | | 9/1971 | French et al. | |
| 3,742,668 | A | | 7/1973 | Oliver | |
| 3,826,054 | A | * | 7/1974 | Culpepper, Jr. | 52/309.8 |
| 3,868,300 | A | | 2/1975 | Wheeler | |
| 3,887,410 | A | | 6/1975 | Lindner | |
| 3,941,632 | A | | 3/1976 | Swedenberg et al. | |
| 3,944,698 | A | | 3/1976 | Dierks et al. | |
| 3,993,822 | A | | 11/1976 | Knauf et al. | |
| 3,998,021 | A | | 12/1976 | Lewis | |
| 4,015,391 | A | | 4/1977 | Epstein et al. | |
| 4,033,702 | A | | 7/1977 | Moerk, Jr. | |
| 4,033,802 | A | | 7/1977 | Culpepper, Jr. et al. | |
| 4,034,528 | A | | 7/1977 | Sanders et al. | |
| 4,065,333 | A | | 12/1977 | Lawlis et al. | |
| 4,073,997 | A | | 2/1978 | Richards et al. | |
| 4,081,939 | A | | 4/1978 | Culpepper, Jr. et al. | |
| 4,096,011 | A | | 6/1978 | Sanders et al. | |
| 4,098,044 | A | | 7/1978 | Slavik | |
| 4,181,767 | A | | 1/1980 | Steinau | |
| 4,188,762 | A | | 2/1980 | Tellman | |
| 4,242,406 | A | | 12/1980 | El Bouhnini et al. | |
| 4,244,761 | A | * | 1/1981 | Remi et al. | 156/71 |
| 4,277,526 | A | | 7/1981 | Jackson | |
| 4,288,959 | A | | 9/1981 | Murdock | |
| 4,296,169 | A | | 10/1981 | Shannon | |
| 4,301,633 | A | | 11/1981 | Neumann | |
| 4,303,722 | A | | 12/1981 | Pilgrim | |
| 4,318,258 | A | * | 3/1982 | Heck | 52/309.12 |
| 4,335,177 | A | | 6/1982 | Takeuchi | |
| 4,351,867 | A | | 9/1982 | Mulvey et al. | |
| 4,361,616 | A | | 11/1982 | Bomers | |
| 4,366,197 | A | | 12/1982 | Hanlon et al. | |
| 4,369,610 | A | | 1/1983 | Volan | |
| 4,399,643 | A | | 8/1983 | Hafner | |
| 4,437,274 | A | | 3/1984 | Slocum et al. | |
| 4,468,909 | A | | 9/1984 | Eaton | |
| 4,477,300 | A | | 10/1984 | Pilgrim | |
| 4,504,533 | A | | 3/1985 | Altenhofer et al. | |
| 4,506,486 | A | | 3/1985 | Culpepper et al. | |
| 4,586,304 | A | | 5/1986 | Flamand | |
| 4,637,860 | A | | 1/1987 | Harper et al. | |
| 4,647,496 | A | | 3/1987 | Lehnert et al. | |
| 4,686,803 | A | * | 8/1987 | Couderc et al. | 52/97 |
| 4,722,866 | A | | 2/1988 | Wilson et al. | |
| 4,745,716 | A | | 5/1988 | Kuypers | |
| 5,502,940 | A | * | 4/1996 | Fifield | 52/309.12 |
| 5,511,346 | A | * | 4/1996 | Kenworthy | 52/169.5 |
| 5,553,431 | A | * | 9/1996 | Pelosi et al. | 52/287.1 |
| 5,615,525 | A | * | 4/1997 | Kenworthy | 52/169.5 |
| 5,636,489 | A | * | 6/1997 | Leverrier et al. | 52/540 |
| 5,791,109 | A | | 8/1998 | Lehnert et al. | |
| 5,799,446 | A | | 9/1998 | Tamlyn | |
| D402,770 | S | | 12/1998 | Hendrickson et al. | |
| 5,945,182 | A | | 8/1999 | Fowler et al. | |
| 5,960,598 | A | | 10/1999 | Tamlyn | |
| 5,981,406 | A | | 11/1999 | Randall | |
| 5,987,835 | A | | 11/1999 | Santarossa | |
| 6,018,924 | A | | 2/2000 | Tamlyn | |
| 6,195,952 | B1 | * | 3/2001 | Culpepper et al. | 52/522 |
| 6,263,574 | B1 | | 7/2001 | Lubker, II et al. | |
| 6,276,107 | B1 | | 8/2001 | Waggoner et al. | |
| D448,865 | S | | 10/2001 | Manning | |
| D450,138 | S | | 11/2001 | Barber | |
| 6,354,049 | B1 | | 3/2002 | Bennett | |
| 6,367,222 | B1 | | 4/2002 | Timbrel et al. | |
| 6,418,610 | B2 | | 7/2002 | Lubker, II et al. | |
| 6,449,915 | B1 | * | 9/2002 | Park | 52/407.1 |
| 6,494,010 | B1 | * | 12/2002 | Miller et al. | 52/578 |
| D471,292 | S | | 3/2003 | Barber | |
| 6,609,337 | B1 | * | 8/2003 | O'Connell | 52/101 |
| 6,684,597 | B1 | | 2/2004 | Butcher | |
| 6,792,725 | B1 | | 9/2004 | Rutherford | |
| 6,852,185 | B2 | * | 2/2005 | Sanger | 156/71 |
| 6,886,301 | B2 | | 5/2005 | Schilger | |
| 6,990,775 | B2 | | 1/2006 | Koester | |
| 7,059,087 | B2 | | 6/2006 | Allen | |
| 7,117,651 | B2 | | 10/2006 | Beck | |
| 7,921,606 | B2 | * | 4/2011 | Quaranta et al. | 52/57 |
| 8,006,455 | B1 | * | 8/2011 | Mollinger et al. | 52/519 |
| 8,297,020 | B1 | * | 10/2012 | Swanson | 52/540 |
| 8,336,269 | B1 | * | 12/2012 | Mollinger et al. | 52/302.4 |
| 8,371,085 | B2 | * | 2/2013 | Koch | 52/520 |
| 2002/0029537 | A1 | | 3/2002 | Manning et al. | |
| 2003/0029097 | A1 | | 2/2003 | Albracht | |
| 2003/0056458 | A1 | | 3/2003 | Black et al. | |
| 2004/0050015 | A1 | * | 3/2004 | Foster | 52/746.1 |
| 2004/0200171 | A1 | | 10/2004 | Schilger | |
| 2004/0200183 | A1 | | 10/2004 | Schilger | |
| 2005/0210806 | A1 | * | 9/2005 | Guerra | 52/518 |
| 2006/0068188 | A1 | | 3/2006 | Morse et al. | |

FOREIGN PATENT DOCUMENTS

| | | |
|---|---|---|
| CA | 993779 | 7/1976 |
| DE | 2808723 | 1/1980 |
| EP | 0148760 | 1/1985 |
| EP | 0148761 | 1/1985 |
| EP | 0943040 | 10/1997 |
| EP | 0973699 | 4/1998 |
| JP | 63294317 | 1/1988 |
| JP | 2141484 | 11/1988 |
| JP | 5147997 | 11/1991 |
| JP | 04189938 | 6/1992 |
| JP | 03337538 | 6/1993 |
| JP | 6008219 | 1/1994 |
| WO | WO-9816697 | 4/1998 |
| WO | WO-9845222 | 10/1998 |
| WO | WO-9957392 | 11/1999 |
| WO | WO 00/21901 | 4/2000 |
| WO | WO 00/61519 | 10/2000 |
| WO | WO-0142164 | 6/2001 |
| WO | WO-0225034 | 3/2002 |
| WO | WO-0231287 | 4/2002 |
| WO | WO-02070247 | 9/2002 |
| WO | WO-02070248 | 9/2002 |
| WO | WO-02070425 | 9/2002 |
| WO | WO-02081399 | 10/2002 |
| WO | WO-2004018090 | 3/2004 |

* cited by examiner

FOAM INSULATION BOARD WITH EDGE SEALER

CROSS REFERENCE TO RELATED APPLICATIONS

This application is a continuation-in-part of U.S. patent application Ser. No. 12/817,313, filed on Jun. 17, 2010, which is a divisional of U.S. patent application Ser. No. 11/025,623, filed on Dec. 29, 2004, now U.S. Pat. No. 7,762,040, which claims priority to U.S. Provisional Patent Application Ser. No. 60/600,845 filed on Aug. 12, 2004. The disclosures of these applications are hereby fully incorporated by reference in their entirety.

FIELD OF THE INVENTION

The invention is related to an insulated fiber cement siding.

BACKGROUND OF THE INVENTION

A new category of lap siding, made from fiber cement or composite wood materials, has been introduced into the residential and light commercial siding market during the past ten or more years. It has replaced a large portion of the wafer board siding market, which has been devastated by huge warranty claims and lawsuits resulting from delamination and surface irregularity problems.

Fiber cement siding has a number of excellent attributes which are derived from its fiber cement base. Painted fiber cement looks and feels like wood. It is strong and has good impact resistance and it will not rot. It has a Class 1(A) fire rating and requires less frequent painting than wood siding. It will withstand termite attacks. Similarly composite wood siding has many advantages.

Fiber cement is available in at least 16 different faces that range in exposures from 4 inches to 10.75 inches. The panels are approximately 5/16 inch thick and are generally 12 feet in length. They are packaged for shipment and storage in units that weigh roughly 5,000 pounds.

Fiber cement panels are much heavier than wood and are hard to cut requiring diamond tipped saw blades or a mechanical shear. Composite wood siding can also be difficult to work with. For example, a standard 12 foot length of the most popular 8¼ inch fiber cement lap siding weighs 20.6 pounds per piece. Moreover, installers report that it is both difficult and time consuming to install. Fiber cement lap siding panels, as well as wood composite siding panels, are installed starting at the bottom of a wall. The first course is positioned with a starter strip and is then blind nailed in the 1¼ inch high overlap area at the top of the panel (see FIG. 1). The next panel is installed so that the bottom 1¼ inch overlaps the piece that it is covering. This overlap is maintained on each successive course to give the siding the desired lapped siding appearance. The relative height of each panel must be meticulously measured and aligned before the panel can be fastened to each subsequent panel. If any panel is installed incorrectly the entire wall will thereafter be miss-spaced.

Current fiber cement lap siding has a very shallow 5/16 inch shadow line. The shadow line, in the case of this siding, is dictated by the 5/16 inch base material thickness. In recent years, to satisfy customer demand for the impressive appearance that is afforded by more attractive and dramatic shadow lines virtually all residential siding manufacturers have gradually increased their shadow lines from ½ inch and ⅝ inch to ¾ inch and 1 inch.

SUMMARY OF THE INVENTION

Disclosed herein are embodiments of foam backing panels for use with lap siding and configured for mounting on a building. One such embodiment of the foam backing panel comprises a rear face configured to contact the building, a front face configured for attachment to the lap siding, alignment means for aligning the lap siding relative to the building, means for providing a shadow line, opposing vertical side edges, a top face extending between a top edge of the front face and rear face and a bottom face extending between a bottom edge of the front face and rear face.

Also disclosed herein are embodiments of lap board assemblies. One such assembly comprises the foam backing panel described above, with the alignment means comprising alignment ribs extending a width of the front face, the alignment ribs spaced equidistant from the bottom edge to the top edge of the front face. A plurality of lap boards is configured to attach to the foam backing panel, each lap board having a top edge and a bottom edge, the top edge configured to align with one of the alignment ribs such that the bottom edge extends beyond an adjacent alignment rib.

Also disclosed herein are methods of making the backing and lap board. One such method comprises providing a lap board and joining a porous, closed cell foam to a substantial portion of a major surface of the fiber cement substrate, the foam providing a drainage path through cells throughout the foam.

Also disclosed in embodiments is a foam insulation board comprising: a front face and a rear face; a first side edge and a second side edge; and a top edge and a bottom edge. The top edge includes a top joining element, and the bottom edge includes a bottom joining element complementary in shape to the top joining element. The first side edge includes a first joining element, and the second side edge includes a second joining element complementary in shape to the first joining element. An adhesive is present on at least one face of the top joining element, the bottom joining element, the first joining element, or the second joining element.

Several specific embodiments are contemplated. In one embodiment, the top joining element is a tongue, and the one face with the adhesive is a front face of the tongue. In another embodiment, the top joining element is a tongue, and the one face with the adhesive is an upper face of the tongue. In a different embodiment, the bottom joining element is a groove, and the one face with the adhesive is a rear face of the groove. In another embodiment, the bottom joining element is a groove, and the one face with the adhesive is a lower face of the groove. In the next embodiment, the second joining element is a tongue, and the one face with the adhesive is a front face of the tongue. In another embodiment, the second joining element is a tongue, and the one face with the adhesive is a sideward face of the tongue. In still another embodiment, the first joining element is a groove, and the one face with the adhesive is a rear face of the groove. In a final embodiment, the first joining element is a groove, and the one face with the adhesive is a sideward face of the groove.

In some general embodiments, the one face with the adhesive is a front face of the joining element. In other general embodiments, the one face with the adhesive is a rear face of the joining element. In still some other embodiments, the one face with the adhesive is a sideward face of the joining element.

The adhesive may be covered with a pull-off strip. The adhesive may be a UV curable adhesive, a hot melt adhesive, a thermosetting or thermoplastic adhesive, a pressure sensitive adhesive, or a solvent-based adhesive.

The rear face of the foam board may further comprise drainage grooves. The foam insulation board may be made of expanded polystyrene. The foam insulation board may further comprise a plurality of registration ribs positioned longitudinally across the front face and spaced equidistantly.

BRIEF DESCRIPTION OF THE DRAWINGS

The description herein makes reference to the accompanying drawings wherein like reference numerals refer to like parts throughout the several views, and wherein.

DETAILED DESCRIPTION

The invention outlined hereinafter addresses the concerns of the aforementioned shortcomings or limitations of current fiber cement siding 10.

Figure 1:
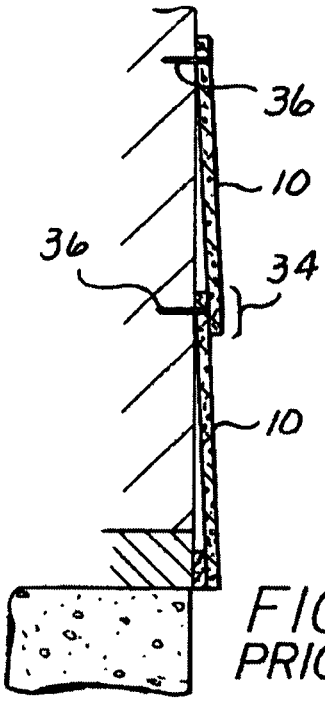
FIG. 1 PRIOR ART
FIG. 1 is a sectional view of a prior art fiber cement panel installation.
Figure 2A:
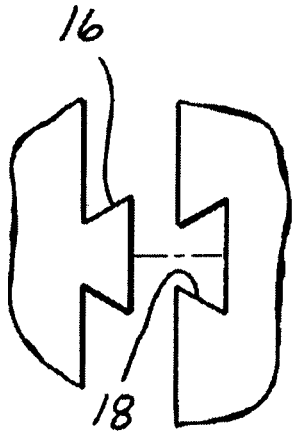
FIG. 2*a* is a portion of the installation board shown in FIG. 2 featuring interlocking tabs.
Figure 2:
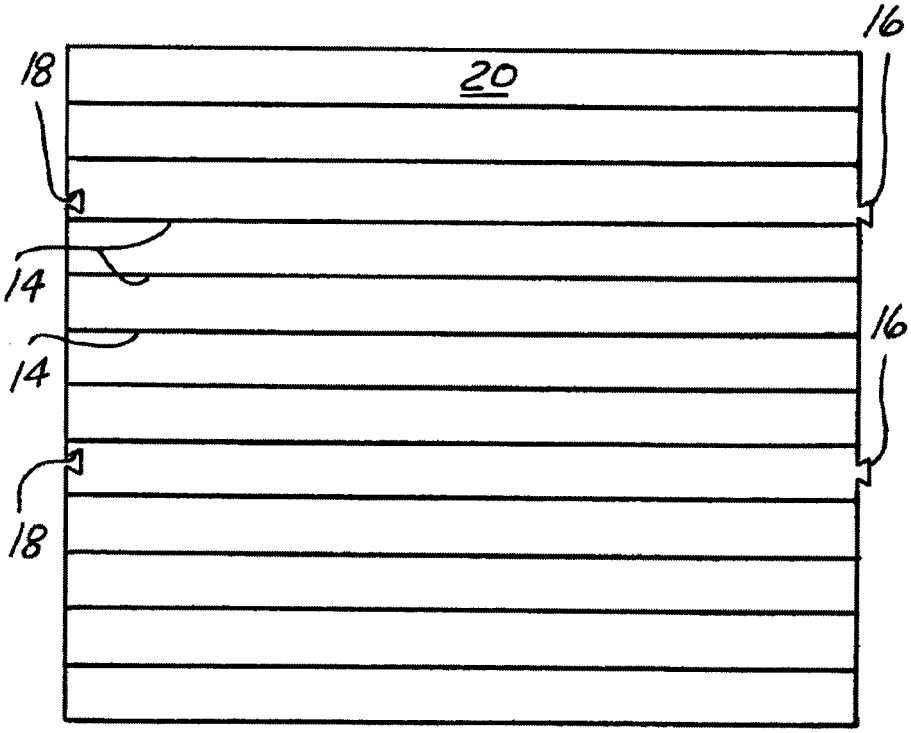
FIG. 2 is a plan view of a contoured alignment installation board according to a first preferred embodiment of the present invention.

A shape molded, extruded or wire cut foam board 12 has been developed to serve as a combination installation/alignment tool and an insulation board. This rectangular board 12, shown in FIG. 2 is designed to work with 1¼ inch trim accessories. The board's 12 exterior dimensions will vary depending upon the profile it has been designed to incorporate, see FIG. 3.

With reference to FIG. 2 there is shown a plan view of a contoured foam alignment backer utilized with the installation method of the first preferred embodiment. Installation and alignment foam board 12 includes a plurality or registration of alignment ribs 14 positioned longitudinally across board 12. Alignment board 12 further includes interlocking tabs 16 which interlock into grooves or slots 18. As illustrated in FIG. 2*a*, and in the preferred embodiment, this construction is a dovetail arrangement 16, 18. It is understood that the dovetail arrangement could be used with any type of siding product, including composite siding and the like where it is beneficial to attach adjacent foam panels.

Typical fiber cement lap siding panels 10 are available in 12 foot lengths and heights ranging from 5¼ inches to 12 inches. However, the foam boards 12 are designed specifically for a given profile height and face such as, Dutch lap, flat, beaded, etc. Each foam board 12 generally is designed to incorporate between four and twelve courses of a given fiber cement lap siding 10. Spacing between alignment ribs 14 may vary dependent upon a particular fiber cement siding panel 10 being used. Further size changes will naturally come with market requirements. Various materials may also be substituted for the fiber cement lap siding panels 10.

One commercially available material is an engineered wood product coated with special binders to add strength and moisture resistance; and further treated with a zinc borate-based treatment to resist fungal decay and termites. This product is available under the name of LP SmartSide® manufactured by LP Specialty Products, a unit of Louisiana-Pacific Corporation (LP) headquartered in Nashville, Tenn. Other substituted materials may include a combination of cellulose, wood and a plastic, such as polyethylene. Therefore, although this invention is discussed with and is primarily beneficial for use with fiber board, the invention is also applicable with the aforementioned substitutes and other alternative materials such as vinyl and rubber.

Figure 3:
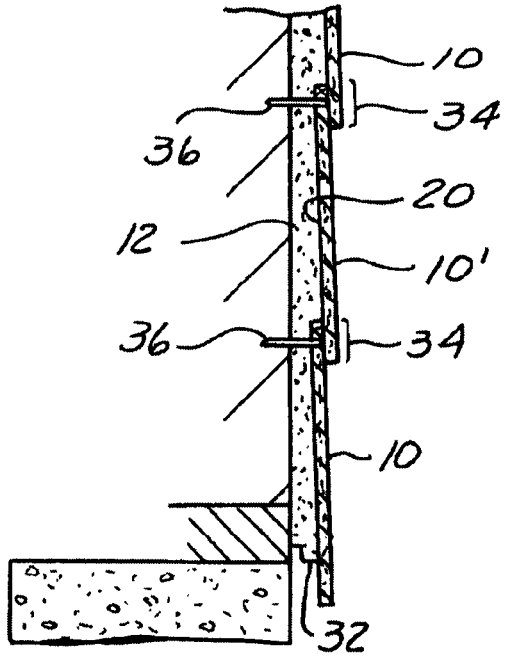
FIG. 3 is a sectional view of a fiber cement or wood composite installation using a first preferred method of installation.
Figure 4:
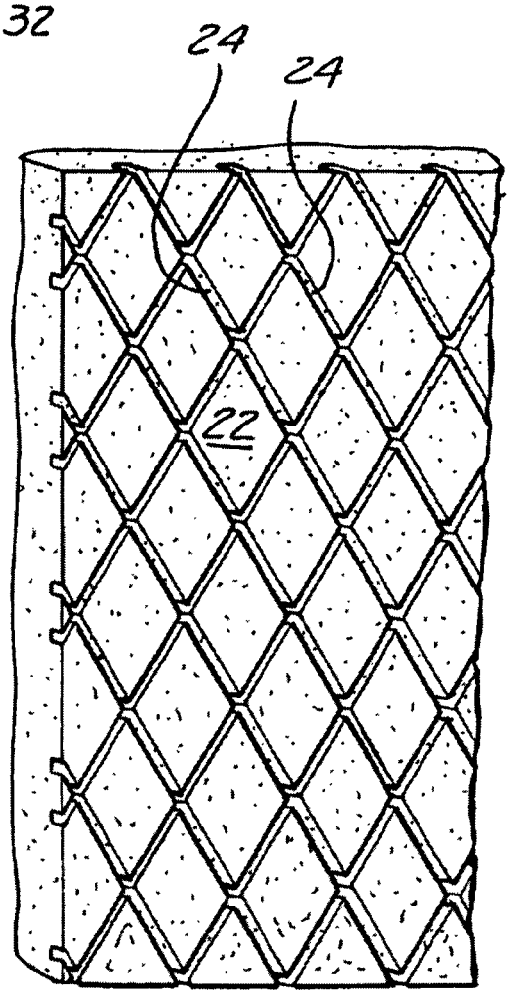
FIG. 4 is a rear perspective view of the installation board of FIG. 2.

The foam boards 12 incorporate a contour cut alignment configuration on the front side 20, as shown in FIG. 3. The back side 22 is flat to support it against the wall, as shown in FIG. 4. The flat side 22 of the board, FIG. 4, will likely incorporate a drainage plane system 24 to assist in directing moisture runoff, if moisture finds its way into the wall 12. It should be noted that moisture in the form of vapor, will pass through the foam from the warm side to the cold side with changes in temperature. The drainage plane system is incorporated by reference as disclosed in Application Ser. No. 60/511,527 filed on Oct. 15, 2003.

To install the fiber cement siding, according to the present invention, the installer must first establish a chalk line 26 at the bottom of the wall 28 of the building to serve as a straight reference line to position the foam board 12 for the first course 15 of foam board 12, following siding manufacturer's instructions.

Figure 5:
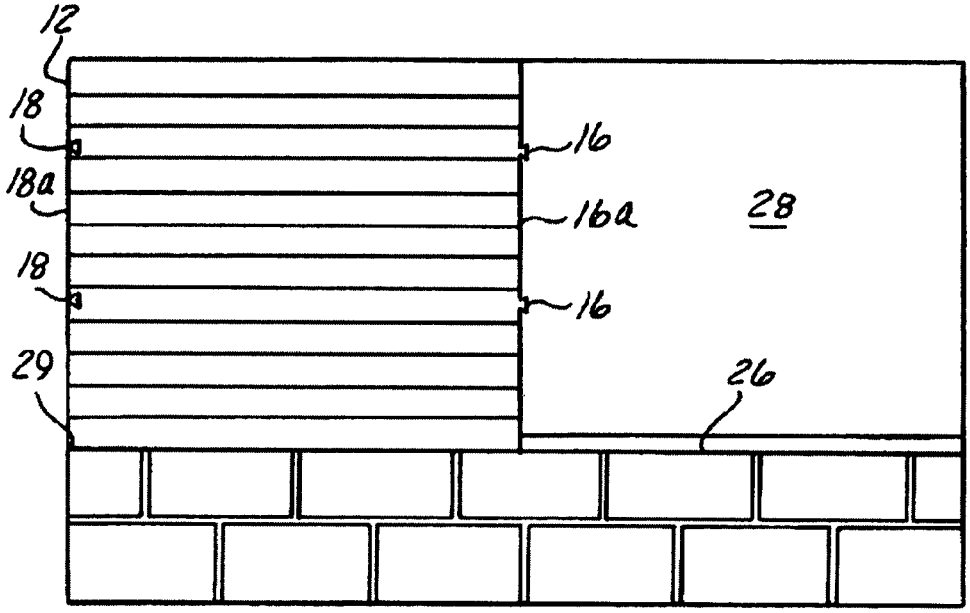
FIG. 5 is a plan view of an installation board according to a first preferred embodiment of the present invention attached to a wall.
Figure 6:
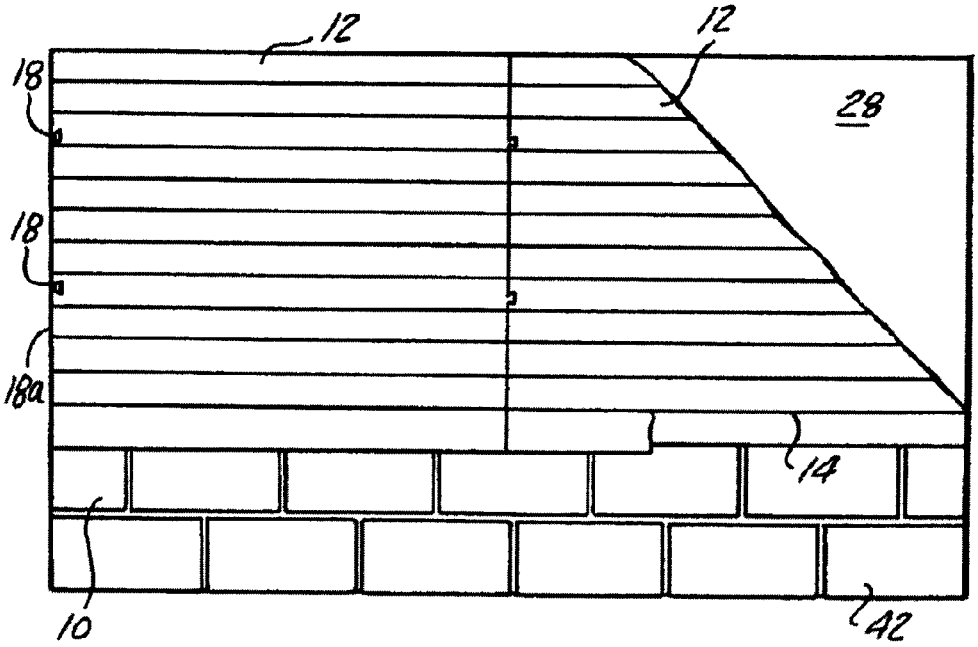
FIG. 6 is a plan view of an installation board on a wall.
Figure 7:
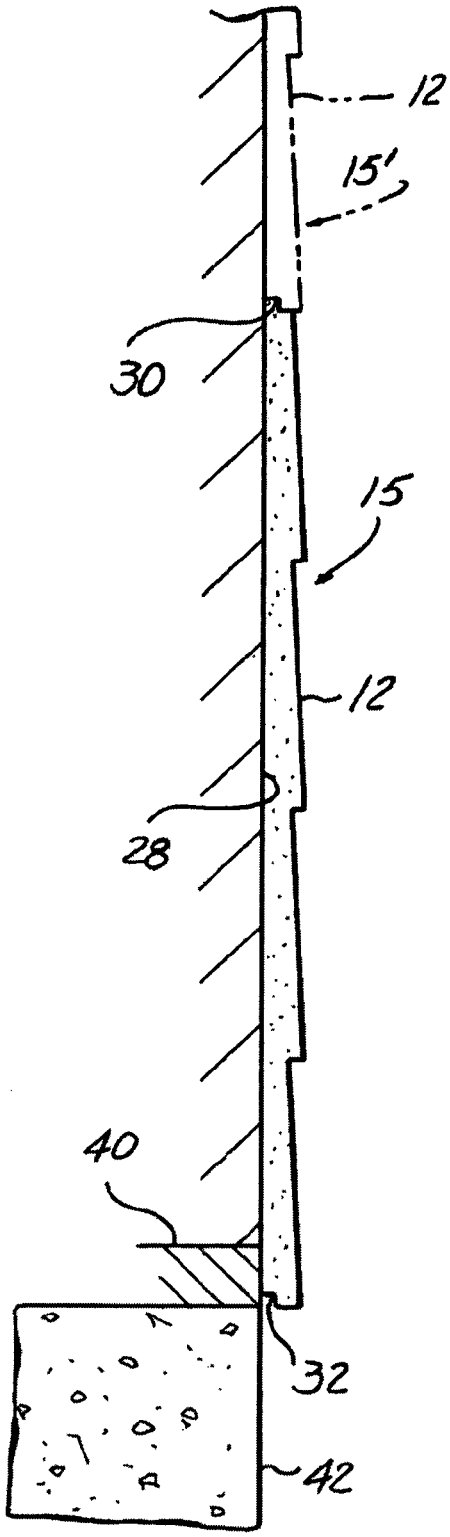
FIG. 7 is a sectional view of the installation board illustrating the feature of a ship lap utilized to attach multiple EPS foam backers or other foam material backers when practicing the method of the first preferred embodiment of the present invention.
Figure 7A:
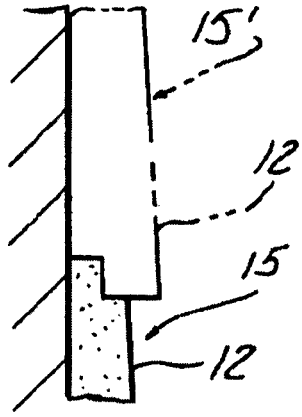
FIG. 7*a* is a sectional view of an upper ship lap joint.
Figure 7B:
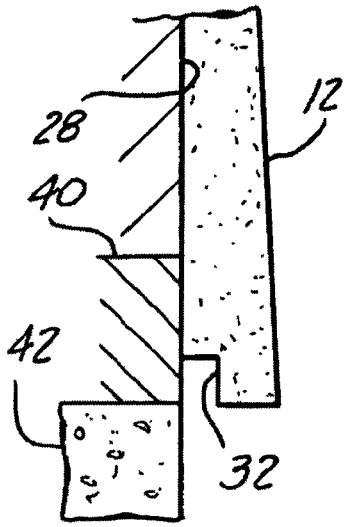
FIG. 7*b* is a sectional view of a lower ship lap joint.

The foam boards 12 are designed to be installed or mated tightly next to each other on the wall 28, both horizontally and vertically. The first course foam boards 12 are to be laid along the chalk line 26 beginning at the bottom corner of an exterior wall 28 of the building (as shown FIG. 5) and tacked into position. When installed correctly, this grid formation provided will help insure the proper spacing and alignment of each piece of lap siding 10. As shown in FIGS. 5 and 6, the vertical edges 16*a*, 18*a* of each foam board 12 are fabricated with an interlocking tab 16 and slot 18 mechanism that insure proper height alignment. Ensuring that the tabs 16 are fully interlocked and seated in the slots 18, provides proper alignment of the cement lap siding. As shown in FIGS. 7, 7*a*, 7*b*, the horizontal edges 30, 32 incorporate ship-lapped edges 30, 32 that allow both top and bottom foam boards 12 to mate tightly together. The foam boards 12 are also designed to provide proper horizontal spacing and alignment up the wall 28 from one course to the next, as shown in phantom in FIGS. 7 and 7*a*.

As the exterior wall 28 is covered with foam boards 12, it may be necessary to cut and fit the foam boards 12 as they mate next to doorways. windows, gable corners, electrical outlets, water faucets, etc. This cutting and fitting can be accomplished using a circular saw, a razor knife or a hot knife. The opening (not shown) should be set back no more than ⅛ inches for foundation settling.

Once the first course 15 has been installed, the second course 15' of foam boards 12 can be installed at any time. The entire first course 15 on any given wall should be covered before the second course 15' is installed. It is important to insure that each foam board 12 is fully interlocked and seated on the interlocking tabs 16 to achieve correct alignment.

The first piece of fiber cement lap siding 10 is installed on the first course 15 of the foam board 12 and moved to a position approximately ⅛ inches set back from the corner and pushed up against the foam board registration or alignment rib 14 (see FIG. 8) to maintain proper positioning of the panel 10. The foam board registration or alignment rib 14 is used to align and space each fiber cement panel 10 properly as the siding job progresses. Unlike installing the fiber cement lap siding in the prior art, there is no need to measure the panel's relative face height to insure proper alignment. All the system mechanics have been accounted for in the rib 14 location on the foam board 12. The applicator simply places the panel 10 in position and pushes it tightly up against the foam board alignment rib 14 immediately prior to fastening. A second piece of fiber cement lap siding can be butted tightly to the first, pushed up against the registration or alignment rib and fastened securely with fasteners 17 with either a nail gun or hammer. Because the alignment ribs 14 are preformed and pre-measured to correspond to the appropriate overlap 30 between adjacent fiber cement siding panels 10, no measurement is required. Further, because the alignment ribs 14 are level with respect to one another, an installer need not perform the meticulous leveling tasks associated with the prior art methods of installation.

With reference to FIGS. 7, 7*a*, 7*b*, vertically aligned boards 20 include a ship lap 30, 32 mating arrangement which provides for a continuous foam surface. Furthermore, the interlocking tabs 16, 18 together with the ship lap 30, 32 ensures that adjacent fiber boards 12, whether they be vertically adjacent or horizontally adjacent, may be tightly and precisely mated together such that no further measurement or alignment is required to maintain appropriate spacing between adjacent boards 12. It is understood that as boards 12 are mounted and attached to one another it may be necessary to trim such boards when windows, corners, electrical outlets, water faucets, etc. are encountered. These cuts can be made with a circular saw, razor knife, or hot knife.

Thereafter, a second course of fiber cement siding 10' can be installed above the first course 10 by simply repeating the steps and without the need for leveling or measuring operation. When fully seated up against the foam board alignment rib 14, the fiber cement panel 10' will project down over the first course 10 to overlap 34 by a desired 1¼ inches, as built into the system as shown in FIG. 3. The next course is fastened against wall 28 using fasteners 36 as previously described. The foam board 12 must be fully and properly placed under all of the fiber cement panels 10. The installer should not attempt to fasten the fiber cement siding 10 in an area that it is not seated on and protected by a foam board 12.

The board 12, described above, will be fabricated from foam at a thickness of approximately 1¼ inch peak height. Depending on the siding profile, the board 12 should offer a system "R" value of 3.5 to 4.0. This addition is dramatic considering that the average home constructed in the 1960's has an "R" value of 8. An R-19 side wall is thought to be the optimum in thermal efficiency. The use of the foam board will provide a building that is cooler in the summer and warmer in the winter. The use of the foam board 12 of the present invention also increases thermal efficiency, decreases drafts and provides added comfort to a home.

Figure 9:
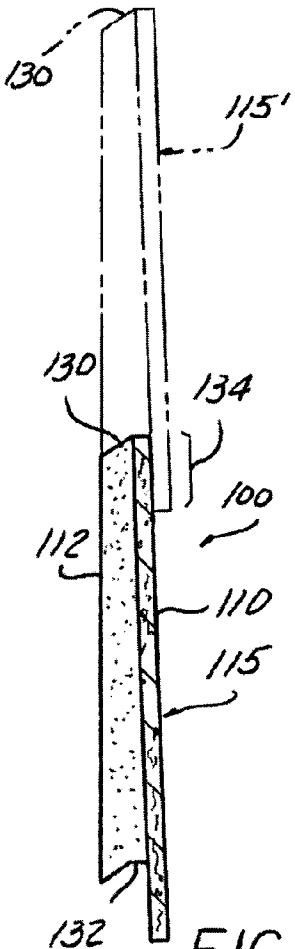
FIG. 9 is a second preferred embodiment of a method to install a fiber cement panel.

In an alternate embodiment, a family of insulated fiber cement lap siding panels 100 has been developed, as shown in FIG. 9, in the interest of solving several limitations associated with present fiber cement lap sidings. These composite panels 100 incorporate a foam backer 112 that has been bonded or laminated to a complementary fiber cement lap siding panel 110. Foam backing 112 preferably includes an angled portion 130 and a complementary angled portion 132 to allow multiple courses of composite fiber cement siding panels 100 to be adjoined. Foam backer 112 is positioned against fiber cement siding 110 in such a manner as to leave an overlap region 134 which will provide for an overlap of siding panels on installation.

The fiber cement composite siding panels 100 of the second preferred embodiment may be formed by providing appropriately configured foam backing pieces 132 which may be adhesively attached to the fiber cement siding panel 110.

Figure 10C:
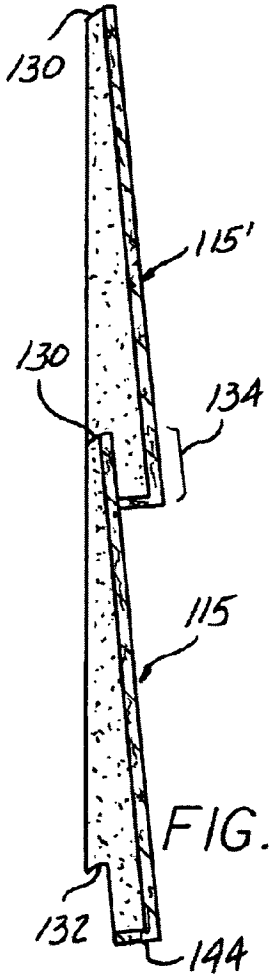
FIG. 10*c* shows the cement board in FIG. 8*d* installed over an installation board of the present invention.
Figure 10B:
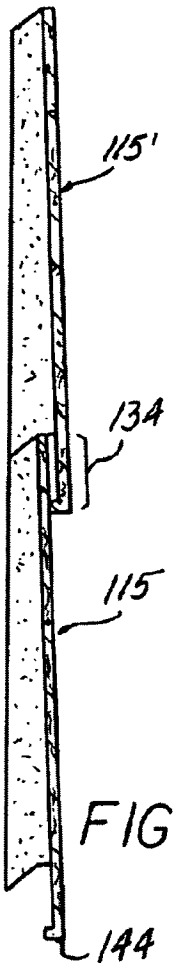
FIG. 10*b* shows the cement board in FIG. 8*c* installed over an installation board of the present invention.
Figure 13:
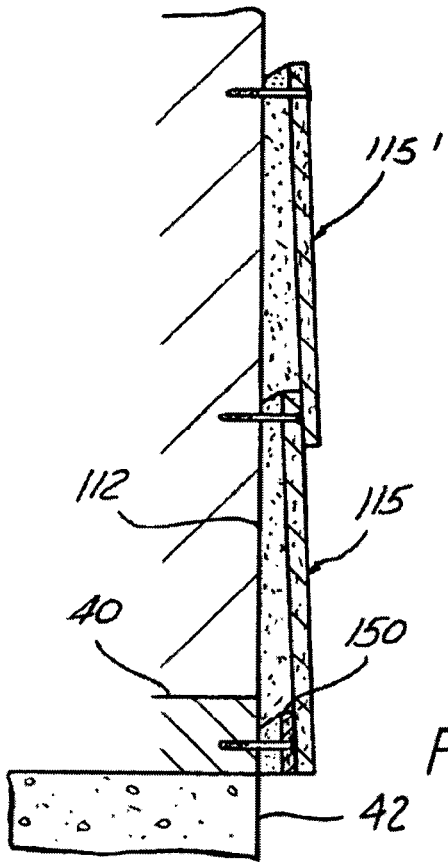
FIG. 13 illustrates a method for installing a first and second layer of fiber cement or wood composite panels.

The composite siding panels 100 according to the second preferred embodiment may be installed as follows with reference to FIGS. 10*b*, 10*c* and 13. A first course 115 is aligned appropriately against sill plate 40 adjacent to the foundation 42 to be level and is fastened into place with fasteners 36. Thereafter, adjacent courses 115' may be merely rested upon the previous installed course and fastened into place. The complementary nature of angled portions 130, 132 will create a substantially uniformed and sealed foam barrier behind composite siding panels 100. Overlap 134, which has been pre-measured in relation to the foam pieces allows multiple courses to be installed without the need for measuring or further alignment. This dramatic new siding of the present invention combines an insulation component with an automatic self-aligning, stack-on siding design. The foam backer 112 provides a system "R" value in the range of 3.5 to 4.0. The foam backer 112 will also be fabricated from expanded polystyrene (EPS), which has been treated with a chemical additive to deter termites and carpenter ants.

The new self-aligning, stack-on siding design of the present invention provides fast, reliable alignment, as compared to the time consuming, repeated face measuring and alignment required on each course with the present lap design.

Figure 8A:
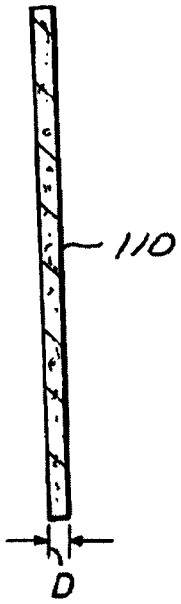
FIG. 8A PRIOR ART
FIG. 8*a* is a sectional view of the fiber cement board of the prior art panel.
Figure 8B:
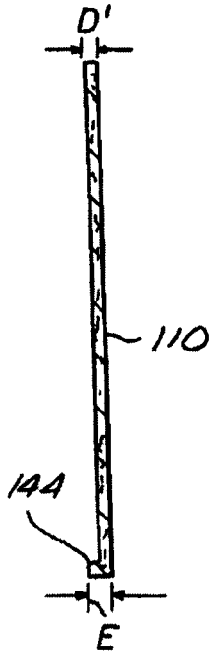
FIGS. 8*b*-8*d* are sectional views of fiber cement boards having various sized shadow lines.
Figure 8C:
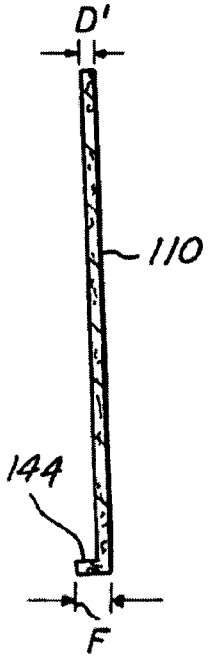

The new foam backer 112 has significant flexural and compressive strength. The fiber cement siding manufacturer can reasonably take advantage of these attributes. The weight of the fiber cement siding 110 can be dramatically reduced by thinning, redesigning and shaping some of the profiles of the fiber cement 110. FIG. 8*a* shows the current dimensions of fiber cement boards, FIGS. 8*b*, 8*c*, and 8*c* show thinner fiber cement board. Experience with other laminated siding products has shown that dramatic reductions in the base material can be made without adversely affecting the product's performance. The combination of weight reduction with the new stack-on design provides the installers with answers to their major objections. It is conceivable that the present thickness (D') of fiber cement lap siding panels 110 of approximately 0.313 inches could be reduced to a thickness (D') of 0.125 inches or less.

The fiber cement siding panel may include a lip 144 which, when mated to another course of similarly configured composite fiber cement siding can give the fiber cement siding 110 the appearance of being much thicker thus achieving an appearance of an increased shadow line. Further, it is understood although not required, that the fiber cement siding panel 110 may be of substantially reduced thickness, as stated supra, compared to the 5/16" thickness provided by the prior art. Reducing the thickness of the fiber cement siding panel 110 yields a substantially lighter product, thereby making it far easier to install. A pair of installed fiber cement composite panels having a thickness (D') of 0.125 or less is illustrated in FIGS. 8B-8D and 10B and 10C. Such installation is carried out in similar fashion as that described in the second preferred embodiment.

Figure 8D:
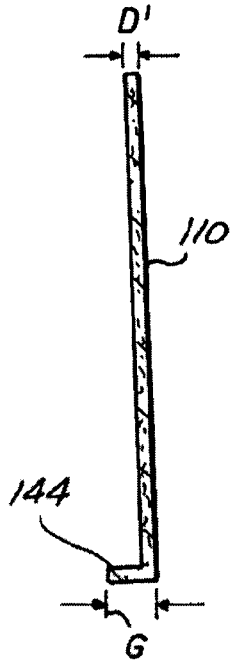
Figure 10A:
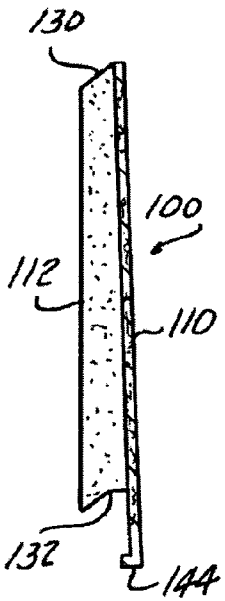
FIG. 10*a* shows the cement board in FIG. 8*b* installed over an installation board of the present invention.

The present invention provides for an alternate arrangement of foam 112 supporting the novel configuration of fiber cement paneling. In particular, the foam may include an undercut recess 132 which is configured to accommodate an adjacent piece of foam siding. As shown in FIGS. 10*a*, 10*b* and 10*c*, the new, thinner, insulated fiber cement lap siding panel 110 will allow the siding manufacturers to market panels with virtually any desirable shadow line, such as the popular new ¾ inch vinyl siding shadow line with the lip 144 formation. The lip 144 can have various lengths such as approximately 0.313 inch (E), 0.50 inch (F), and 0.75 (G) inch to illustrate a few variations as shown in FIGS. 8*b*, 8*c*, and 8*d*, respectively. This new attribute would offer an extremely valuable, previously unattainable, selling feature that is simply beyond the reach with the current system.

Figure 11:
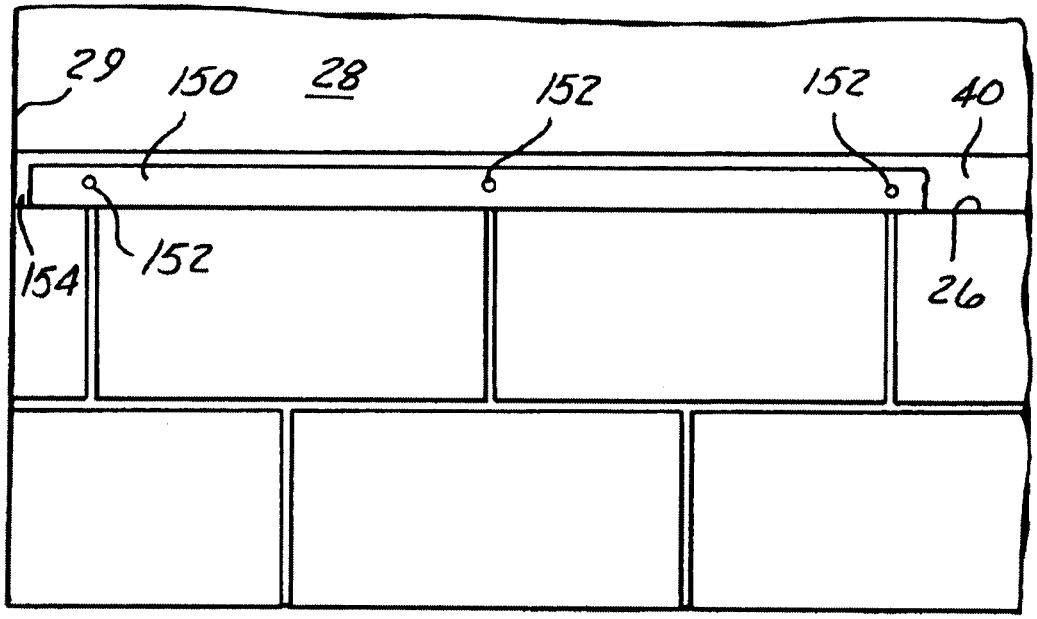
FIG. 11 illustrates the improved fiber cement or wood composite panel utilizing an installation method using a cement starter board strip.
Figure 12:
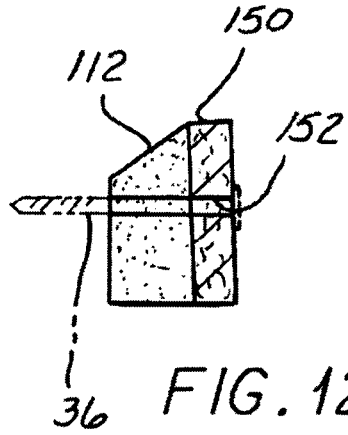
FIG. 12 is a sectional view of a starter board strip having a foam backer.

No special tools or equipment are required to install the new insulated fiber cement lap siding 100. However, a new starter adapter or strip 150 has been designed for use with this system, as shown in FIGS. 11 and 12. It is preferable to drill nail holes 152 through the adapter 150 prior to installation. The installer must first establish a chalk line 26 at the bottom of the wall 28 to serve as a straight reference line to position the starter adapter 150 for the first course of siding and follow the siding manufacturer's instructions.

The siding job can be started at either corner 29. The siding is placed on the starter adapter or strip 150 and seated fully and positioned, leaving a gap 154 of approximately ⅛ inches from the corner 29 of the building. Thereafter, the siding 100 is fastened per the siding manufacturer's installation recommendations using a nail gun or hammer to install the fasteners 36. Thereafter, a second course of siding 115' can be installed above the first course 115 by simply repeating the steps, as shown in FIG. 13. Where practical, it is preferable to fully install each course 115 before working up the wall, to help insure the best possible overall alignment. Installation in difficult and tight areas under and around windows, in gable ends, etc. is the same as the manufacturer's instruction of the current fiber cement lap siding 10.

The lamination methods and adhesive system will be the same as those outlined in U.S. Pat. Nos. 6,019,415 and 6,195,952B1.

The insulated fiber cement stack-on sliding panels 100 described above will have a composite thickness of approximately 1¼ inches. Depending on the siding profile, the composite siding 100 should offer a system "R" value of 3.5 to 4.0. This addition is dramatic when you consider that the average home constructed in the 1960's has an "R" value of 8. An "R-19" side wall is thought to be the optimum in energy efficiency. A building will be cooler in the summer and warmer in the winter with the use of the insulated fiber cement siding of the present invention.

In some particular aspects of the disclosure, the foam backing panel or foam insulation board includes an adhesive along one of the edges, which is useful for sealing the edges of adjacent backing panels or insulation boards to provide a uniform insulation layer with no cracks through which heat may be lost. The adhesive may be present on an entire edge or a portion thereof. For example, when the edges of the foam insulation board are arranged in a ship-lap configuration, one or all of the ship-lap surfaces may comprise the adhesive. In particular, the edge may have one or more faces on which the adhesive is present. More generally speaking, the horizontal and vertical edges of the insulation board are shaped to be complementary, which aids in joining them together and sealing any cracks between them.

Figure 14:
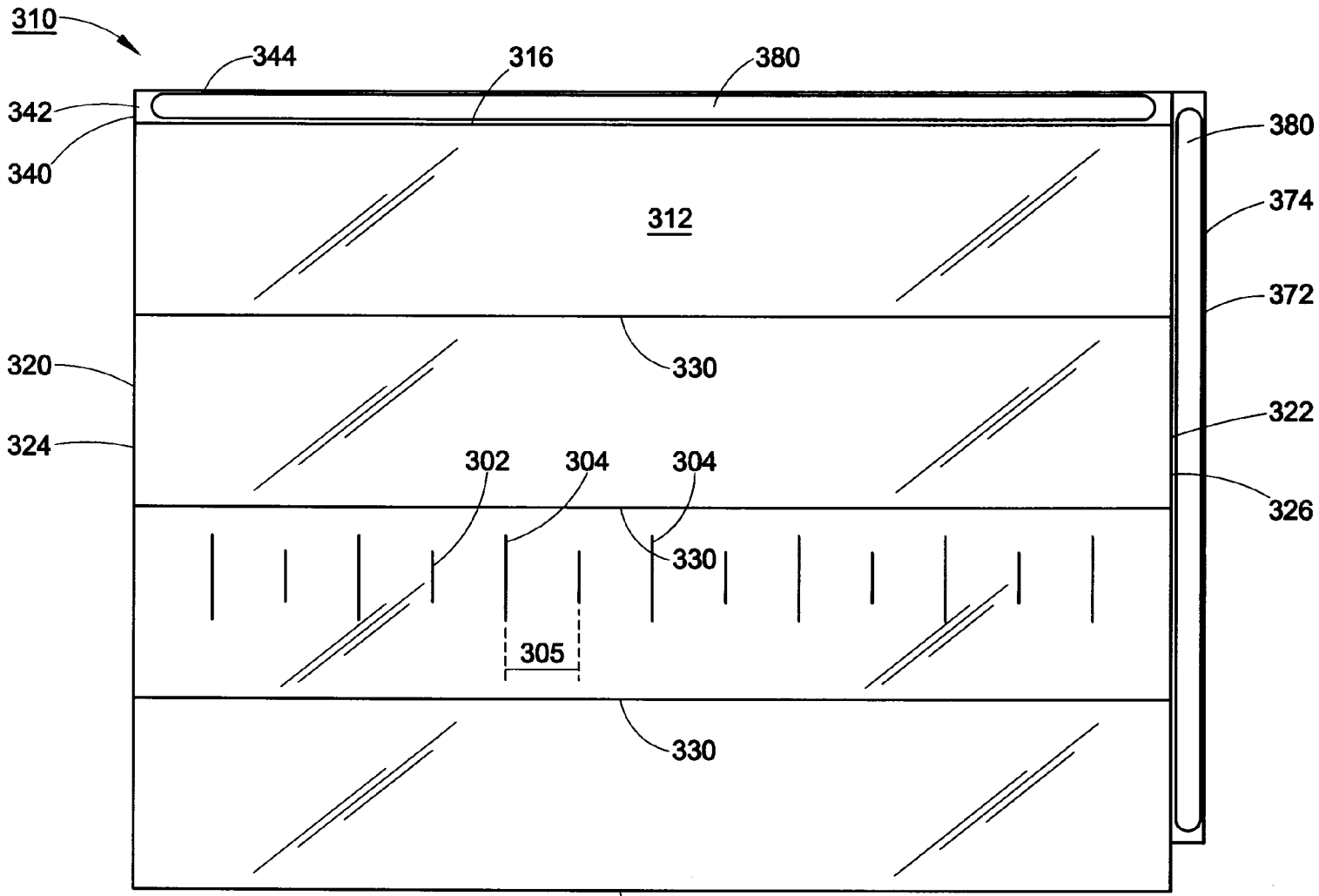
FIG. 14 is a front view of an exemplary foam insulation board having adhesive applied to an edge.
Figure 15:
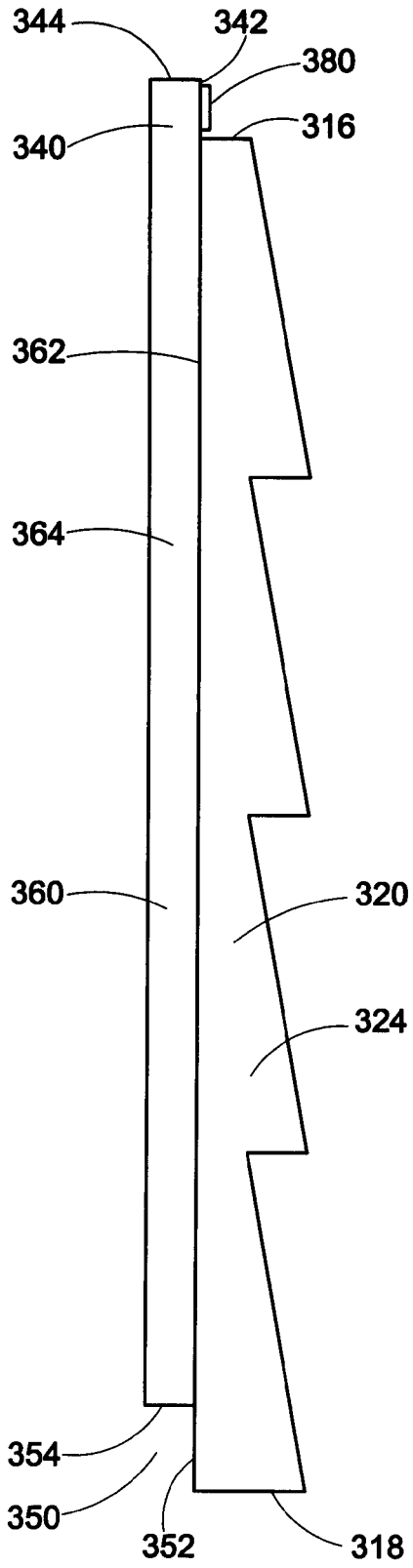
FIG. 15 is a left side view of the foam insulation board of FIG. 14.
Figure 16:
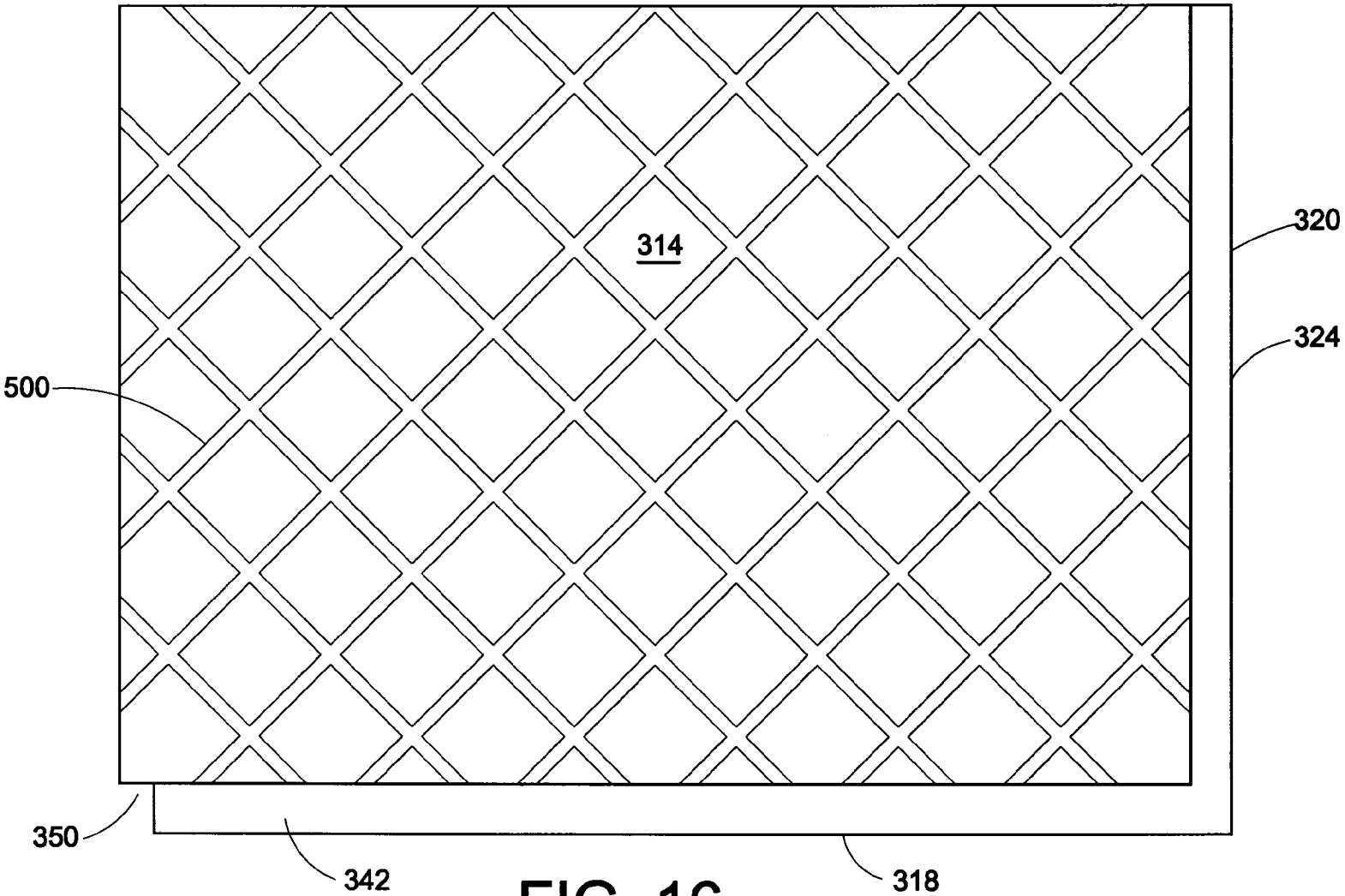
FIG. 16 is a rear view of the foam insulation board of FIG. 14.
Figure 17:
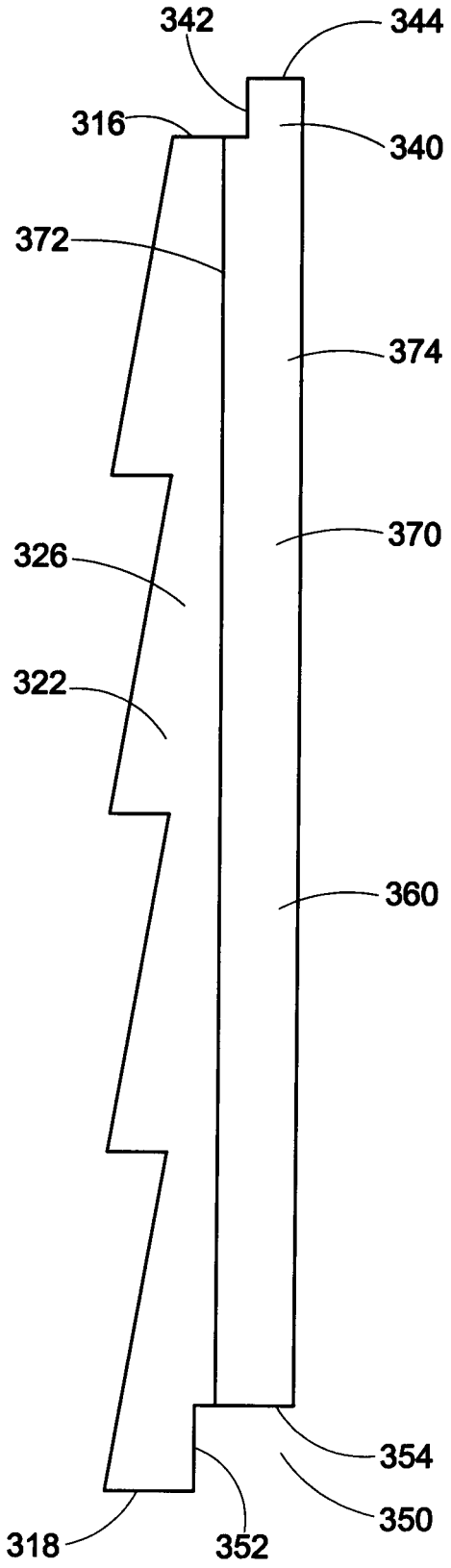
FIG. 17 is a right side view of the foam insulation board of FIG. 14.
Figure 18:
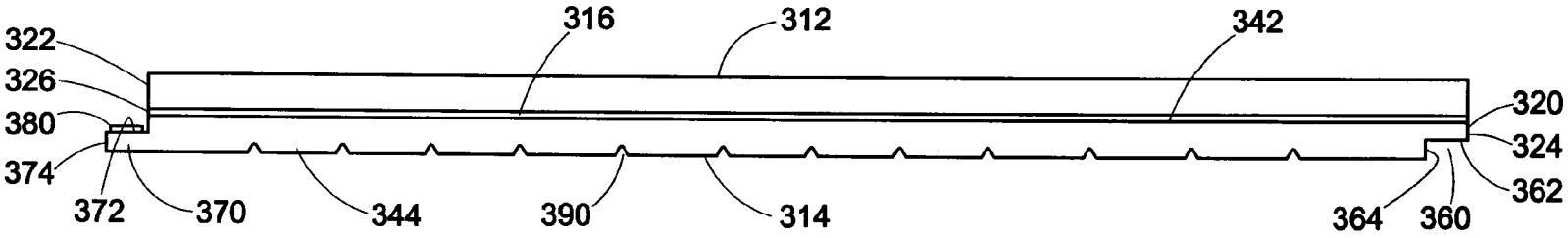
FIG. 18 is a top view of the foam insulation board of FIG. 14.
Figure 19:
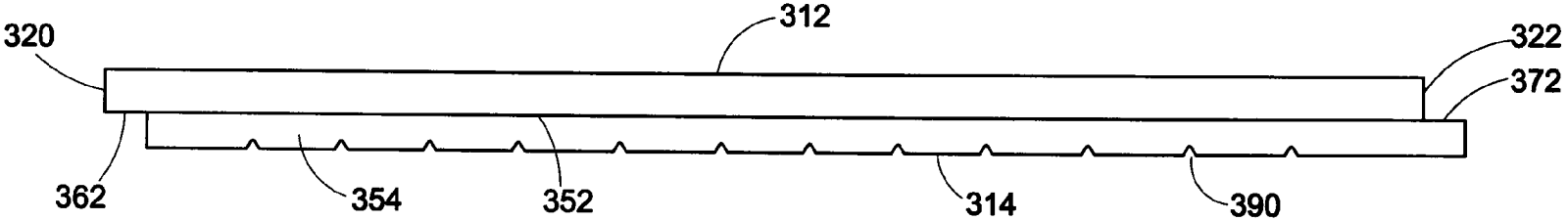
FIG. 19 is a bottom view of the foam insulation board of FIG. 14.

FIGS. 14-19 show one example embodiment of a foam insulation board having adhesive applied to an face. FIG. 14 is a front view of the board. FIG. 15 is a left side view of the board. FIG. 16 is a rear view of the board. FIG. 17 is a right side view of the board. FIG. 18 is a top view of the board. FIG. 19 is a bottom view of the board. The foam board is attached to the exterior wall of the building being insulated, and siding panels (like those depicted in FIGS. 8B-8D) are attached to the foam board.

The foam board 310 has a front face 312, a rear face 314, a top face 316, a bottom face 318, a left side face 320, and a right side face 322. In this regard, the left side face 320 and the right side face 322 can also be considered as being a first side face 324 and a second side face 326. Here, the left side face 320 is labeled as being the first side face 324, and the right side face is labeled as the second side face 322. The top face 316 and the bottom face 318 may be considered to be horizontal faces of the foam board. The left side face 320 and the right side face 322 may be considered to be vertical faces of the foam board.

Referring to FIG. 14 and FIG. 15, the front face 312 here is shown having a contour cut alignment. However, it is also contemplated that the foam board could be flat, i.e. the distance between the front face 312 and the rear face 314 is generally constant between the top face 316 and the bottom face 318. A plurality of registration ribs 330 are positioned longitudinally across the front face of the foam board and run from one side face 320 of the board to the other side face 322, generally parallel to the top face 316 and the bottom face 318. The ribs are spaced equidistantly from each other. Please note that the top face 316 and bottom face 318 should also be considered registration ribs because when adjacent panels are stacked upon each other, they have the same effect as the ribs 330. Again, the foam board is generally designed to incorporate between four and twelve courses of siding. Siding panels (not shown) can be attached to the front face of the foam board. The top edge of each siding panel is abutted and positioned by a registration rib 330.

Referring to FIG. 15, the top face 316 includes a top joining element 340. The bottom face 318 includes a bottom joining element 350. The top joining element 340 is complementary in shape to the bottom joining element 350, such that panels stacked upon each other are joined together in a shiplap arrangement to mate tightly together. Here, the top joining element 340 is shown as a tongue along the rear face of the foam board. The tongue includes a front face 342 that faces in the forward direction, and includes an upper face 344 that faces in an upward direction. The bottom joining element 350 is shown as a groove along the rear face of the foam board. The groove includes a rear face 352 that faces in the rearward direction, and includes a lower face 354 that faces in a downward direction. Put another way, the front face 342 of the top joining element is directed in the opposite direction of the rear face 352 of the second joining element. Similarly, the upper face 344 of the top joining element is directed in the opposite direction of the lower face 354 of the bottom joining element.

Referring now to FIG. 15, FIG. 17, and FIG. 18, the first side face 324 includes a first joining element 360. The second side face 326 includes a second joining element 370. The first joining element 360 is complementary in shape to the second joining element 370, such that panels arranged laterally to each other (i.e. side-by-side) are joined together in a shiplap arrangement to mate tightly together. Here, the second joining element 370 is shown as a tongue along the rear face of the foam board. The tongue includes a front face 372 that faces in the forward direction, and includes a sideward face 374 that faces in a sideways direction (here, the right side). The first joining element 360 is shown as a groove along the rear face of the foam board. The groove includes a rear face 362 that faces in the rearward direction, and includes a sideward face 364 that faces in a sideways direction (here, the left side). Put another way, the sideward face 364 of the first joining element is directed in the opposite direction of the sideward face 374 of the second joining element. Similarly, the rear face 362 of the first joining element is directed in the opposite direction of the front face 372 of the second joining element. It should also be noted that some of the faces described herein overlap, especially at the corners of the foam board.

It should be noted that the first joining element 360 and the second joining element 370 may be as simple as the first side face 324 and the second side face 326 being parallel planes. There is no requirement that the first and second joining elements must be a structure that extends from or protrudes into the respective side face.

An adhesive is pre-applied to the foam insulation board during the manufacturing process, so that the siding installer does not have to laboriously apply such adhesive during the installation process. The adhesive may be present on any one or more of the edges/faces that overlap between panels. More specifically, the adhesive may be present on any one or combination of the following faces: the front face 342 of the top joining element; the upper face 344 of the top joining element; the rear face 352 of the bottom joining element; the lower face 354 of the bottom joining element; the front face 372 of the second joining element; the sideward face 374 of the second joining element; the rear face 362 of the first joining element; the sideward face 364 of the first joining element; the first side face 324, and the second side face 326. In some specific embodiments, adhesive is present only on the front face 342 of the top joining element. In other specific embodiments, adhesive is present on only one of the horizontal faces (i.e. either the top joining element 340 or the bottom joining element 350) and on only one of the vertical faces (i.e. either the first joining element 360 or the second joining element 370). As an example, adhesive 380 is shown in FIG. 14 and FIG. 18 as being present on the front face 342 of the top joining element and on the front face 372 of the second joining element.

The adhesive which is used on the sides/edges of the foam board may be used over the entire surface or used in discrete locations. Suitable adhesives may include, but are not limited to, UV curable adhesives and hot melt adhesives, such as polyamines and urethanes, glue, thermosetting or thermoplastic adhesives, pressure sensitive adhesives or solvent-based adhesives. Desirably, the adhesive is a pressure sensitive adhesive, which forms a bond upon application of light pressure.

Figure 20:
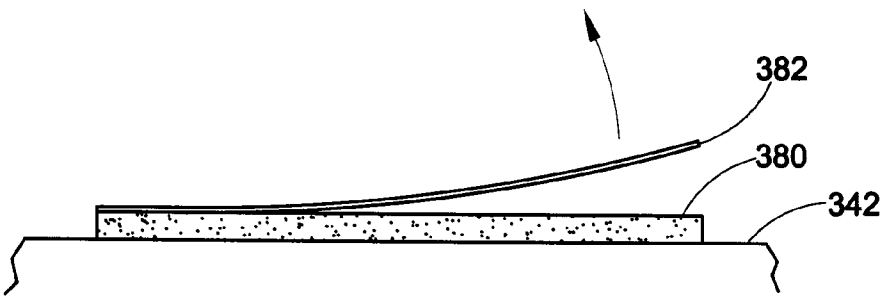
FIG. 20 is a magnified view showing an adhesive film covered with a pull-off strip.

In particular embodiments, the foam board is packaged with the adhesive covered up with a pull-off strip. FIG. 20 is a magnified view of a front face 342 of a top joining element. An layer or film of adhesive 380 is present on the front face. Here, the pull-off strip 382 is partially pulled off to expose the adhesive. When the pull-off strip 382 is completely removed, the adhesive film 380 is ready to be adhered to a surface of another foam insulation board. Before the pull-off strip 382 is removed, none of the adhesive 380 is exposed and the surface of the pull-off strip 382 can contact other materials without sticking, allowing for easier handling. The pull-off strip can be subsequently removed at a work site. For example, the pull-off strip 382 can be removed and the adhesive can be brought into contact with the bottom face of a different foam insulation board to join the adjacent insulation boards together.

The foam board of FIGS. 14-19 may include additional features. For example, the opposing vertical sides of the foam board may include the interlocking tab and slot arrangement illustrated in FIG. 2A. As another example, FIG. 16, FIG. 18, and FIG. 19 show drainage grooves 390 in the rear face 314 of the foam board. Drainage grooves can also be placed on the front face 312 of the foam board if desired.

An especially desirable feature which may be present on any embodiment of the foam insulation boards discussed herein is a plurality or series of relative distance markers or indicators. Such relative distance markers 302 are visible on the embodiment seen in FIG. 14. In this regards, there is a constant distance 305 between adjacent markers. Put another way, the relative distance markers 302 are positioned longitudinally across the front face of the foam insulation board and are spaced equidistantly. These distance markers are helpful to installers because the foam insulation board is typically fastened (e.g. nailed) to the wall studs (vertical members) in the building. In North America, studs are typically placed at regular intervals of 12, 16, or 24 inches. The relative distance markers 302 allow the installer to quickly locate additional wall studs once the location of the first wall stud has been determined. The relative distance markers are generally carved into the front face. As illustrated here, the relative distance markers are simply straight lines. There are two sets of straight lines here. For example, there can be a distance of four inches between each marker, and a distance of eight inches between the markers labeled with reference numeral 304. It is contemplated that there could be two different sets of relative distance markers having different intervals as well, with each set being indicated by a different color. For example, one set of relative distance markers would have a distance of 12 inches between adjacent markers and be red lines, while the other set of relative distance markers would have a distance of 16 inches between adjacent markers and be green lines. The relative distance markers are hidden by the siding panels (not shown) when installation is completed.

The foam insulation board and the adhesive can be made and used with the common knowledge of one of ordinary skill in the art.

While the invention has been described in connection with what is presently considered to be the most practical and preferred embodiment, it is to be understood that the fiber cement siding board disclosed in the invention can be substituted with the aforementioned disclosed materials and is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A foam insulation board comprising:

a front face and a rear face;

a first side face and a second side face;

a top face and a bottom face; and a plurality of registration ribs positioned longitudinally across the front face and spaced equidistantly from each other, each registration rib running from the first side face to the second side face;

wherein the top face includes a top joining element, and the bottom face includes a bottom joining element complementary in shape to the top joining element;

wherein the first side face includes a first joining element, and the second side face includes a second joining element complementary in shape to the first joining element;

wherein an adhesive is present on at least one face of the top joining element, the bottom joining element, the first joining element, or the second joining element; and wherein the adhesive is covered with a pull-off strip.

2. The foam insulation board of claim 1, wherein the top joining element is a tongue, and the one face with the adhesive is a front face of the tongue.

3. The foam insulation board of claim 1, wherein the top joining element is a tongue, and the one face with the adhesive is an upper face of the tongue.

4. The foam insulation board of claim 1, wherein the bottom joining element is a groove, and the one face with the adhesive is a rear face of the groove.

5. The foam insulation board of claim 1, wherein the bottom joining element is a groove, and the one face with the adhesive is a lower face of the groove.

6. The foam insulation board of claim 1, wherein the second joining element is a tongue, and the one face with the adhesive is a front face of the tongue.

7. The foam insulation board of claim 1, wherein the second joining element is a tongue, and the one face with the adhesive is a sideward face of the tongue.

8. The foam insulation board of claim 1, wherein the first joining element is a groove, and the one face with the adhesive is a rear face of the groove.

9. The foam insulation board of claim 1, wherein the first joining element is a groove, and the one face with the adhesive is a sideward face of the groove.

10. The foam insulation board of claim 1, wherein the one face with the adhesive is a front face of the joining element.

11. The foam insulation board of claim 1, wherein the one face with the adhesive is a rear face of the joining element.

12. The foam insulation board of claim 1, wherein the one face with the adhesive is a sideward face of the joining element.

13. The foam insulation board of claim 1, wherein the adhesive is a UV curable adhesive, a hot melt adhesive, a thermosetting or thermoplastic adhesive, a pressure sensitive adhesive, or a solvent-based adhesive.

14. The foam insulation board of claim 1, wherein the rear face of the foam board further comprises drainage grooves.

15. The foam insulation board of claim 1, wherein the foam board is made of expanded polystyrene.

16. The foam insulation board of claim 1, further comprising a plurality of relative distance markers positioned longitudinally across the front face and spaced equidistantly.

17. The foam insulation board of claim 1, further comprising a first set and a second set of relative distance markers positioned longitudinally across the front face, the first set of relative distance markers having a first distance between adjacent markers, the second set of relative distance markers having a second distance between adjacent markers, the first distance being different from the second distance.

* * * * *